US011193348B2

(12) United States Patent
Lende et al.

(10) Patent No.: US 11,193,348 B2
(45) Date of Patent: Dec. 7, 2021

(54) SECTION MILLED WINDOW CEMENTING DIVERTER

(71) Applicant: Halliburton Energy Services, Inc., Houston, TX (US)

(72) Inventors: Gunnar Lende, Sola (NO); Tor Saetre, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 71 days.

(21) Appl. No.: 16/637,208

(22) PCT Filed: Oct. 6, 2017

(86) PCT No.: PCT/US2017/055623
§ 371 (c)(1),
(2) Date: Feb. 6, 2020

(87) PCT Pub. No.: WO2019/070297
PCT Pub. Date: Apr. 11, 2019

(65) Prior Publication Data

US 2020/0370393 A1 Nov. 26, 2020

(51) Int. Cl.
*E21B 33/138* (2006.01)
*E21B 34/14* (2006.01)
(Continued)

(52) U.S. Cl.
CPC ..... *E21B 33/138* (2013.01); *E21B 33/12* (2013.01); *E21B 33/13* (2013.01); *E21B 33/16* (2013.01);
(Continued)

(58) Field of Classification Search
CPC ..... E21B 27/02; E21B 33/13; E21B 33/134; E21B 33/138; E21B 33/16; E21B 34/063; E21B 34/142; E21B 41/0078
See application file for complete search history.

(56) References Cited

U.S. PATENT DOCUMENTS 4,377,127 A * 3/1983 Tinchon ..... E21D 11/00 118/306
4,441,556 A 4/1984 Powers et al.
(Continued)

OTHER PUBLICATIONS

International Search Report and Written Opinion dated Jul. 2, 2018; International PCT Application No. PCT/US2017/055623.

*Primary Examiner* — Tara Schimpf
(74) *Attorney, Agent, or Firm* — McGuireWoods LLP

(57) ABSTRACT

Provided are cement plugging apparatuses and methods of use. An example cement plugging apparatus comprises a detachable plug fundament assembly comprising: a throughbore, a first plurality of wiper elements, and a second plurality of wiper elements. The examples cement plugging apparatus further comprises a cement diverting assembly coupled to the plug fundament assembly, wherein the cement diverting assembly comprises: a plurality of hoses, a body, a throughbore in the body, and a plurality of flow paths extending through the body and having openings for each individual flow path in the throughbore; wherein each individual hose in the plurality is coupled to an individual flow path in the plurality; and wherein each individual hose in the plurality extends away from the body of the cement diverting assembly.

31 Claims, 8 Drawing Sheets

(51) Int. Cl.

| | |
|---|---|
| ***E21B 33/12*** | (2006.01) |
| ***E21B 34/06*** | (2006.01) |
| ***E21B 41/00*** | (2006.01) |
| ***E21B 33/13*** | (2006.01) |
| ***E21B 33/16*** | (2006.01) |
| *E21B 27/02* | (2006.01) |

(52) U.S. Cl.
CPC ..... *E21B 34/063* (2013.01); *E21B 34/142* (2020.05); *E21B 41/0078* (2013.01); *E21B 27/02* (2013.01); *E21B 2200/06* (2020.05)

(56) References Cited

U.S. PATENT DOCUMENTS

| | | | | |
|---|---|---|---|---|
| 5,722,491 | A * | 3/1998 | Sullaway | E21B 33/16 166/291 |
| 8,136,594 | B2 * | 3/2012 | Streich | E21B 33/14 166/292 |
| 2003/0164237 | A1 | 9/2003 | Butterfield | |
| 2004/0216879 | A1 | 11/2004 | Rogers et al. | |
| 2013/0112434 | A1 | 5/2013 | Lende et al. | |
| 2016/0053571 | A1 * | 2/2016 | Ludewigt | E21B 47/06 166/285 |
| 2019/0128092 | A1 * | 5/2019 | Mueller | E21B 33/1208 |

* cited by examiner

SECTION MILLED WINDOW CEMENTING DIVERTER

TECHNICAL FIELD

The present disclosure relates to the use of cementing diverters for cement plugging operations in a wellbore, and more particularly, to the use of a cement plugging apparatus comprising a disconnecting plug fundament assembly and a reusable cement diverting assembly to provide a cement plug across section milled windows or washed out intervals.

BACKGROUND

Cement plugs may be placed across a section milled window or a washed out interval to plug a lower, nonproductive portion of the well, to drill a sidetrack of an existing well, or to kick-off directional drilling of the well. The purpose of the cement plug is to isolate the portion of the wellbore and subterranean formation downhole of the cement plug. Current methods of placing plugs across section milled windows or washed out intervals may be inefficient or have other drawbacks due to the potentially unfavorable geometry/geometries.

Present methods of placing cement plugs may require multiple wellbore trips to achieve proper plug placement and to produce a competent cement plug. Moreover, in some wellbores, the target annular area for the cement plug lacks a fundament sufficient for plugging, both in the casing, annulus or in wellbore if no casing stub; and an additional operation to determine the condition of the annulus and/or place a fundament may be needed. Further, the length of the section milled window may be insufficient to place the plug fundament. For example, in some operations, the section milled window may be too short (i.e., less than 40 meters) to allow room for standard plug fundaments, such as inflatable packers, bridge plugs, or high-viscosity pills. As such, additional milling must be done if these plug fundaments are needed, and this may result in additional non-productive time and expense in order to mill through the additional casing and casing collars. Additionally, when the cement plug is to be placed, the cementing diverter may not circulate the cement, fluid or sealant effectively into the wellbore. The cement may not reach the walls of the casing or the wellbore. Further, the cement may simply channel through the center portion of a prior placed fluid, such as the drilling fluid. This may result in poor drilling fluid displacement and affect the condition of the cement plug as it sets. If the cement is not placed correctly, the cement plug may not develop sufficient compressive strength or be too patchy to perform any subsequent operations, and additional plugging operations may be needed to create a successful plug.

As such, inefficiency as well as poor circulation and displacement when placing cement plugs across section milled windows or washed out intervals may result in increased non-productive time and operational expenses.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to the use of cementing diverters for cement plugging operations in a wellbore, and more particularly, to the use of a cement plugging apparatus comprising a disconnecting plug fundament assembly and a reusable cement diverting assembly to provide a cement plug across section milled windows or washed out intervals.

Examples of the methods and systems described herein comprise the use of a cement plugging apparatus. Advantageously, the cement plugging apparatus may be used to provide a fundament for a cement plug, regardless of the condition of the wellbore. Further advantageously, the cement plugging apparatus may be used to effectively displace drilling fluid and circulate a cement along the walls of a wellbore or casing to provide an even cement distribution that forms a competent cement plug on the provided fundament. Moreover, the plug fundament assembly and cement diverting assembly may be run in-hole combined as one cement plugging apparatus such that only one trip may be needed to produce a competent cement plug.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Figure 1:
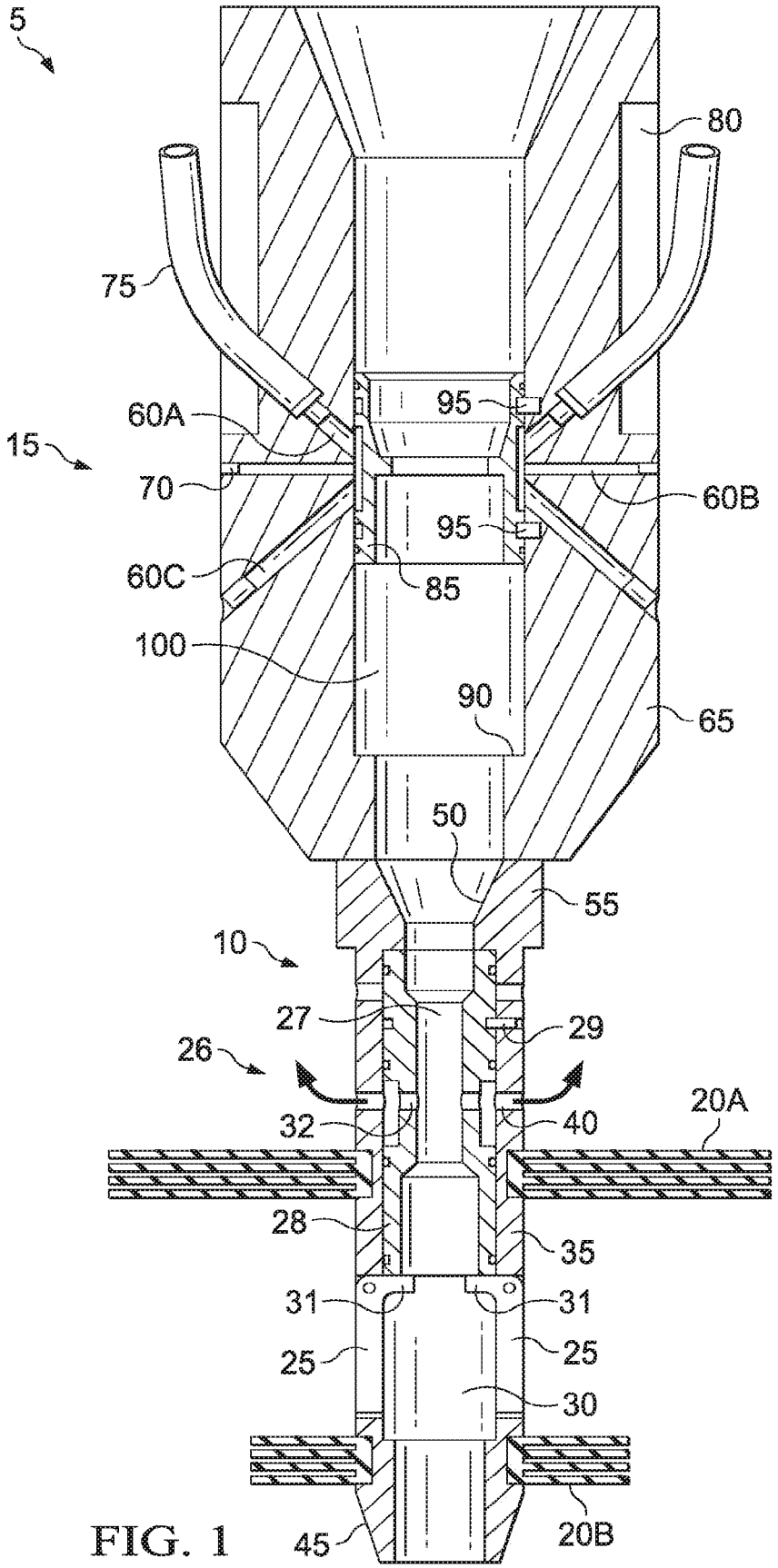
FIG. 1 is a cross-section schematic illustrating an example of a cement plugging apparatus in accordance with the examples disclosed herein.

FIG. 1 is a cross-section schematic illustrating an example of a cement plugging apparatus, generally 5. The cement plugging apparatus 5 comprises two tool assemblies, the plug fundament assembly, generally 10, and the cement diverting assembly, generally 15. The plug fundament assembly 10 may be disconnected from the cement diverting assembly 15 as desired. In some examples, the plug fundament assembly 10 and the cement diverting assembly 15 may be used independently and may not be run-in-hole together as the cement plugging apparatus 5.

Plug fundament assembly 10 may comprise two or more pluralities of wiper elements 20A and 20B, dogs 25, dog actuation assembly 26, throughbore 30, body 35, circulation ports 40, projectile seat 50, disconnect assembly 55, and optionally, guide nose 45. As discussed below, some specific examples may utilize only one plurality of wiper elements.

The plug fundament assembly 10 may comprise two or more pluralities of wiper elements 20A and 20B disposed on either side of the dogs 25 (i.e., uphole of dogs 25 and downhole of dogs 25). In some examples, the plug fundament assembly 10 may comprise more than two pluralities of wiper elements 20A and 20B. Generally, the pluralities of wiper elements 20A and 20B may be used to prevent cement from falling further downhole. The pluralities of wiper elements 20A and 20B may also be used to provide the fundament upon which the cement may form a cement plug. The wiper elements within the plurality of wiper elements 20A and 20B may be made of any sufficiently rigid material capable of supporting the weight of the cement as it sets into a cement plug. Uphole plurality of wiper elements 20A may be used to prevent cement from falling into an outer annulus, for example, a wellbore annulus or casing annulus. Downhole plurality of wiper element 20B may be used to prevent cement from falling through the central conduit, for example, a casing stub. The pluralities of wiper elements 20A and 20B may be flexible enough to collapse as the cement plugging apparatus 5 is run-in-hole, but also rigid enough to support the weight of the cement as it sets to form a cement plug. In the illustrated example, the pluralities of wiper elements 20A and 20B are illustrated as having different lengths or diameters relative to each other in order to cover different sized openings. In some alternative examples, the pluralities of wiper elements 20A and 20B may comprise the same length or diameter. In the illustrated example, the individual wiper elements within a plurality of wiper elements 20A or 20B comprise different lengths and diameters. In some alternative examples, the individual wiper elements within a plurality of wiper elements 20A or 20B may comprise the same length or diameter. In all examples, the plurality of wiper elements 20A and 20B comprise elastomeric materials of sufficient flexibility and rigidity to be run-in-hole and to also support the weight of the cement used to form the cement plug. Examples of materials may include, but are not limited to, natural rubbers, synthetic rubbers, polymers, plastics, metals, composites thereof, or any combination thereof.

In the illustrated example, the pluralities of wiper elements 20A and 20B comprise a plurality of individual wiper elements. The number of wiper elements in a plurality of wiper elements 20A or 20B may be any number of individual wiper elements as desired. In the illustrated example, the pluralities of wiper elements 20A and 20B individually comprise four wiper elements. In alternative examples, the wiper elements 20A or 20B may individually comprise a lesser or greater number of wiper elements, including 1, 2, 3, 4, 5, 6, 7, 8, 9, 10, or more individual wiper elements. The number of individual wiper elements may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. In the cross-section of FIG. 1, the shapes of the individual wiper elements in the pluralities of wiper elements 20A and 20B are not illustrated. It is to be understood that the shapes of the individual wiper elements may be any such shape sufficient for providing a fundament within a wellbore for a cement plug and for preventing or reducing the passage of cement downhole past the pluralities of wiper elements 20A and 20B. Examples of said shapes include both regular and irregular shapes. Specific examples of potential shapes include, but are not limited to, circular shapes, circular-like shapes, square shapes, square-like shapes, varying diameter, etc. It is to be understood that the shapes of the wiper elements is to be determined based upon the profile and shape of the interior of the conduit into which plug fundament assembly 10 is to be deployed. The individual wipers within the plurality of wiper elements 20A and 20B may comprise different shapes, different lengths, different diameters, etc. as desired. The wiper elements of the pluralities of wiper elements 20A and 20B may be coupled to body 35 of plug fundament assembly 10 in any sufficient manner as would be readily determined by one of ordinary skill in the art.

In the illustrated example of FIG. 1, two pluralities of wiper elements 20A and 20B are illustrated. It is to be understood that in some examples, only one plurality of wiper elements may be used, for example, in open-hole applications or applications that do not have tubing present upon which the plug fundament assembly 10 is to form the plug fundament. Alternatively, more than two pluralities of wiper elements may be used as desired in some examples.

In some examples, the individual wiper elements in the pluralities of wiper elements 20A and 20B may be manufactured eccentric and have the ability to rotate about the body 35 as desired.

Dogs 25 may be used to position and support, at least partially, the weight of the plug fundament assembly 10. The dogs 25 may oscillate between axial and transverse orientations. The dogs 25 may be run-in-hole in the collapsed axial orientation, in order to provide a reduced profile along the axial length of the cement plugging apparatus 5. When desired for use, the dogs 25 may be actuated to swing outwardly to its transverse orientation, where the dogs 25 may be used to position the plug fundament assembly 10 on a structure within the wellbore, for example, a casing stub. The dogs 25 may be any length and made from any material sufficient to position and support plug fundament assembly 10 on a target structure within the wellbore and to prevent the downhole passage of plug fundament assembly 10 past said target structure.

The dogs 25 may be actuated by any sufficient actuating mechanism as would be readily determined by one of ordinary skill in the art. For example, dog actuation assembly 26, may comprise a dog actuation sleeve 28 held uphole of the dogs 25 by shear pins 29. The dog actuation sleeve 28 may have a throughbore 27 with side ports 32 which align with circulation ports 40 when the plug fundament assembly 10 is run in hole. When desired for use, a projectile, discussed below, may be released uphole to apply sufficient pressure to shear pins 29 and release dog actuation sleeve 28 to translate downhole and engage a lip 31 of dogs 25 used to oscillate the dogs 25 to the transverse orientation. Dogs 25 may be held in their axial position by a restraining strip or other such mechanism. Dogs 25 may comprise any sufficient length for supporting and positioning plug fundament assembly 10. Dogs 25 may comprise any material sufficient for supporting and positioning plug fundament assembly 10. Examples of materials include, but are not limited to, metals, plastics, glass, composites thereof, or combinations thereof. It is to be understood that the disclosure expressly contemplates other dog actuation assemblies 26, instead of or in addition to dropping projectiles from uphole to apply pressure to sleeves or other mechanisms, for example, using electronic means such as electronic latches, electro-mechanical devices, or pressure pulses, different fluid properties, etc. For example, an electrical cable may be run downhole to provide an electrical current to actuate dogs 25 via an electro-mechanical actuation assembly. In this specific example, the actuation trigger may be a control uphole used by the wellbore operator. As such, there may not be a need to drop a projectile downhole to actuate the dogs 25 in all examples.

In the illustrated example, four dogs 25 are provided (note: two are obscured) positioned equidistance from each at roughly 90° angles around the axis of the plug fundament assembly 10. In examples, any number of individual dogs 25 may be provided as desired. In some alternative examples, the dogs 25 may comprise any number of individual dogs, including, but not limited to, 1, 2, 3, 4, 5, 6, 7, 8, 9, 10, or more individual dogs spaced around the axis of the plug fundament assembly 10 as desired. The number of individual dogs may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. The shape of the dogs may be any such shape sufficient for supporting and positioning plug fundament assembly 10. Examples of said shapes include both regular and irregular shapes. Specific examples of shapes may include, but are not limited to, triangular shapes, triangular-like shapes, rectangular shapes, rectangular-like shapes, curved shapes, hooking shapes, cylinders, etc. It is to be understood that the shape of the dogs 25 is to be determined based upon the profile and shape of the target structure onto which the dogs 25 are to be deployed. The dogs 25 may be coupled to body 35 of plug fundament assembly 10 in any sufficient manner as would be readily determined by one of ordinary skill in the art.

Although FIG. 1 illustrates the use of dogs 25 and a dog actuation assembly 26, it is to be understood that in some specific examples, the plug fundament assembly 10 may not comprise dogs 25 and/or dog actuation assembly 26. For example, some applications may simply allow the placement of plug fundament assembly 10 without the use of dogs 25 and/or dog actuation assembly 26. In these examples, the plug fundament assembly 10 may be placed in the wellbore as desired, without the use of dogs 25 and/or dog actuation assembly 26, to form a plug fundament for a given application.

Circulation ports 40 may be positioned in the body 35 of plug fundament assembly 10 as desired. In the illustrated example of FIG. 1, circulation ports 40 are positioned uphole of wiper elements 20A and 20B such that when run-in-hole and/or deployed for use, fluid passing through throughbore 30 may be circulated above wiper elements 20A and 20B. The circulation ports 40 may be milled or otherwise designed into the body 35 of plug fundament assembly 10 as desired, in any sufficient manner as would be readily determined by one of ordinary skill in the art. The interior diameter and circumference of circulation ports 40 may be any length as desired. In the illustrated example, four circulation ports 40 are present (note: two are obscured), and are positioned equidistance from each at roughly 90° angles transversely around the axis of the plug fundament assembly 10. In alternative examples, the body 35 of plug fundament assembly 10 may comprise any number of circulation ports 40, including, but not limited to, 1, 2, 3, 4, 5, 6, 7, 8, 9, 10, or more circulation ports 40 spaced around the axis of the plug fundament assembly 10 as desired. The number of circulation ports 40 may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. As discussed above, the side ports 32 of the dog actuation assembly 26 align with the circulation ports 40 to allow fluid flow therethrough when the plug fundament assembly 10 is run in hole.

The body 35 of plug fundament assembly 10 may be made of any sufficient material for withstanding wellbore conditions and supporting a cement plug. Examples of materials include, but are not limited to, metals, plastics, glass, composites thereof, or combinations thereof. The body 35 of plug fundament assembly 10 may comprise a different shape than illustrated. The body 35 of plug fundament assembly 10 may be any shape sufficient for deployment in a wellbore and insertion through wellbore conduits as will be readily recognized by one of ordinary skill in the art. As illustrated, body 35 of plug fundament assembly 10 comprises a guide nose 45. Guide nose 45 is an optional configuration of body 35 and may not be present in all examples of body 35 of plug fundament assembly 10.

The body 35 of plug fundament assembly 10 further comprises a projectile seat 50 and disconnect assembly 55. The disconnect assembly 55 couples the plug fundament assembly 10 to the cement diverting assembly 15. The projectile seat 50 is disposed within disconnect assembly 55. When desired for deployment, plug fundament assembly 10 may be disconnected from cement diverting assembly 15 by releasing a projectile uphole, for example, a foam dart, ball, or the like. The projectile may land on the projectile seat 50 and actuate a release mechanism that decouples plug fundament assembly 10 from cement diverting assembly 15. The release mechanism may be any release mechanism sufficient for decoupling plug fundament assembly 10 from cement diverting assembly 15 as would be readily apparent to one of ordinary skill in the art. Example release mechanisms may include, but are not limited to, shearing shear pins and actuating a collet, applying pressure to release a latch or translate a sleeve, actuating an electronic latch with an electronic signal, electro-mechanical device, pressure pulses or different fluid properties, etc. When decoupled, the plug fundament assembly 10 may be permanently deployed to a target location (e.g., a casing stub in a section milled window) to form a plug fundament for cement, or a different fluid or other type of sealant or material other than the original wellbore fluid.

With continued reference to FIG. 1, cement diverting assembly 15 may comprise flow paths 60A, 60B, and 60C; body 65; nozzles 70; hoses 75; grooves 80; shear sleeve 85; sleeve seat 90; and throughbore 100.

As illustrated in FIG. 1, cement diverting assembly 15 comprises three pluralities of flow paths 60A, 60B, and 60C (e.g., upper, middle, and lower). Flow paths 60A, 60B, and 60C are paths for fluid (e.g., cement, spacer fluid, other fluid, other sealant or gel pill) flow through the body 65 of cement diverting assembly 15. The upper flow paths 60A and the lower flow paths 60C are angled with an incline such that cement flowing through the upper flow paths 60A and the lower flow paths 60C is ejected at an angle to create an angled distribution of the cement out of cement diverting assembly 15. Upper flow paths 60A and lower flow paths 60C may be oriented at any incline as desired, for example, upper flow paths 60A and lower flow paths 60C may be oriented at any angle as desired. For example, the upper flow paths 60A may be greater than 0° and less than 90°. The angle of the upper flow paths 60A and lower flow paths 60C may be −75°, −60°, −45°, −30°, −15°, 15°, 30°, 45°, 60°, 75°, etc. The angle of the upper flow paths 60A and lower flow paths 60C may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. Moreover, in some examples, the individual flow paths within the pluralities of flow paths 60A, 60B, and 60C may be angled at different angles. For example, if the plurality of upper flow paths 60A comprises four individual upper flow paths 60A, one or more of the individual upper flow paths 60 may be oriented at a different angle than the other individual upper flow paths. Middle flow paths 60B are not illustrated as having any degree of incline or decline. However, in some alternative examples, middle flow paths 60B may be oriented at an angle having an incline or decline through body 65 of cement diverting assembly 15 if desired.

The flow paths 60A, 60B, and 60C may be milled or otherwise designed into the body 65 of cement diverting assembly 15 as desired in any sufficient manner as would be readily determined by one of ordinary skill in the art. The interior diameter and circumference of flow paths 60A, 60B, and 60C may be any length as desired. In the illustrated example, the groupings (i.e., upper, middle, or lower) of flow paths 60A, 60B, and 60C comprise four separate and individual flow paths 60A, 60B, and 60C per plurality (note: two are obscured for each grouping). The individual flow paths 60A, 60B, and 60C within each grouping are positioned equidistance from each at roughly 90° angles transversely around the axis of the cement diverting assembly 15 relative to the other individual flow paths 60A, 60B, and 60C within the same grouping. In alternative examples, the body 65 of cement diverting assembly 15 may comprise any number of individual flow paths 60A, 60B, and 60C in each grouping of flow paths 60A, 60B, and 60C, including, but not limited to, 1, 2, 3, 4, 5, 6, 7, 8, 9, 10, or more individual flow paths 60A, 60B, and 60C spaced around the axis of the cement diverting assembly 15 as desired. The number of individual flow paths 60A, 60B, and 60C in a grouping of flow paths 60A, 60B, and 60C may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. Although three pluralities of flow paths 60A, 60B, and 60C are illustrated, the disclosure expressly contemplates more of fewer pluralities of flow paths 60A, 60B, and 60C, as would be apparent to one of ordinary skill in the art. At the terminal ends of each flow path 60A, 60B, and 60C are nozzles 70. Optionally, nozzles 70 may be threaded into the terminal ends of the individual flow paths 60A, 60B, and 60C; or otherwise coupled to the terminal ends of the individual flow paths 60A, 60B, and 60C. Nozzles 70 may be used to control the direction and characteristics of cement flow through individual flow paths 60A, 60B, and 60C. Nozzles 70 may be replaced or substituted for nozzles 70 having different characteristics if desired; or omitted if desired. In some examples, nozzles may be used on only some of or none of the flow paths 60A, 60B, or 60C. In a particular example, upper flow paths 60A and hoses 75 do not comprise nozzles 70.

As illustrated in FIG. 1, upper flow paths 60A are coupled to hoses 75. Hoses 75 are securely coupled to the upper flow paths 60A such that they do not release from upper flow paths 60A. The terminal ends of hoses 75 are unsupported and may whip in any direction as cement flows through the interior of hoses 75. The degree of whipping of the hoses 75 may be a function of the rigidity of the hose material and the velocity with which the cement is ejected from the hoses 75. The length and whipping action of the hoses 75 allows for cement to be ejected at an angle and with a sufficient momentum such that the cement may contact the walls of the wellbore or casing. This ejection of cement from the hoses 75 may provide a more effective displacement of the drilling fluid remaining in the wellbore and circulate the cement along the walls of the wellbore or casing to provide a cement distribution that forms a competent cement plug on the provided fundament of the plug fundament assembly 10. In all examples, hoses 75 comprise elastomeric materials of sufficient flexibility to be able to whip, straighten or physically conduct the cement outwardly away from the cement diverting assembly 15 as the cement flows through the hoses 75. Examples of such materials may include, but are not limited to, natural rubbers, synthetic rubbers, plastics, teflone, silicone, composites thereof, or any combination thereof. The hoses 75 may be provided with or without reinforcement. In all examples, the hoses 75 are to be of a sufficient length such that they are able to conduct the cement to the wall of the wellbore. In some specific examples, the length may be so long that the hoses 75 contact the wall of the wellbore. In the illustrated example, four hoses 75 may be used. (note: two are obscured and one has been removed for clarity of illustration of upper flow paths 60A) The hoses 75 may be positioned equidistance from each at roughly 90° angles around the axis of the cement diverting assembly 15. In alternative examples, any number of individual hoses 75 may be used, including, but not limited to, 1, 2, 3, 4, 5, 6, 7, 8, 9, 10, or more individual hoses 75 spaced around the axis of the cement diverting assembly 15 as desired. The number of individual hoses 75 may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values.

The hose length, diameter, shape, stiffness or material my vary within the sub-set of individual hoses 75. For example, some individual hoses 75 may be of sufficient length to contact the walls of the wellbore and some of the individual hoses may not be of sufficient length to contact the walls of the wellbore. Further examples may comprise individual hoses 75 having different diameters, rigidity, reinforcements, etc. In optional examples, the hoses 75 may be open-ended. In alternative optional examples, the hoses 75 may be configured with a nozzle at the end to straighten out the hose ends by adjustment of the internal pressure. In further optional examples, the hoses 75 may comprise flow-diverting nozzles as the nozzles configured at the end. The flow-diverting nozzles may enhance the distribution of fluid flow (e.g., cement flow) from the end of the hoses 75 by splitting the flow, angling the flow to divert it further, or by increasing the degree of whipping.

The body 65 of cement diverting assembly 15 may be made of any sufficient material for withstanding wellbore conditions and diverting a cement through flow paths 60A, 60B, and 60C. Examples of materials include, but are not limited to, metals, plastics, glass, composites thereof, or any combination thereof. The body 65 of the cement diverting assembly 15 may comprise a different shape than illustrated. The body 65 of the cement diverting assembly 15 may be any shape sufficient for deployment in a wellbore and insertion through wellbore conduits as will be readily recognized by one of ordinary skill in the art. As illustrated, the body 65 of cement diverting assembly 15 comprises grooves. Grooves 80 are an optional configuration of body 65 and may not be present in all examples of the body 65 of the cement diverting assembly 15. The grooves 80 may be milled or designed into the body 65 of the cement diverting assembly 15 in any sufficient manner as would be readily apparent to one of ordinary skill in the art. Hoses 75 may be disposed within the grooves 80 during transport of cement diverting assembly 15 through a wellbore. The hoses 75 tucked within grooves 80 have a reduced profile and as such, may have a reduced risk of contact with the wellbore walls or downhole equipment during transport. If the hoses 75 are undamaged, they may be reused on additional trips with the cement diverting assembly 15, and therefore, the need for replacing hoses 75 may be reduced when the cement diverting assembly 15 is used again.

The body 65 of the cement diverting assembly 15 may comprise a shear sleeve 85 and a sleeve seat 90. Shear pins 95 hold the shear sleeve 85 in the illustrated position such that the shear sleeve 85 covers and seals the interior openings for flow paths 60A, 60B, and 60C. When desired for use as cement diverter, a projectile may be released, for example, a rubber dart, a foam dart, ball, or the like uphole. The projectile may land on a seat or other such shoulder within shear sleeve 85 and apply sufficient pressure to shear sleeve 85 to force the shearing of the shear pins 95. When the shear pins 95 are sheared, the shear sleeve 85 is released from the illustrated position in FIG. 1. The shear sleeve 85 may then translate to a downhole position and may come to rest on the sleeve seat 90. The release mechanism for the shear sleeve 85 may be any release mechanism sufficient for releasing the shear sleeve 85 from the interior of the cement diverting assembly 15 as would be readily apparent to one of ordinary skill in the art. The released projectile within the shear sleeve 85 may block cement flow downhole through the throughbore 100. As such, cement introduced uphole and through the drillpipe (not illustrated) coupled to the cement diverting assembly 15, may not flow through throughbore 100 and instead the cement may be diverted through the opened flow paths 60A, 60B, and 60C as well as hoses 75.

Figure 2:
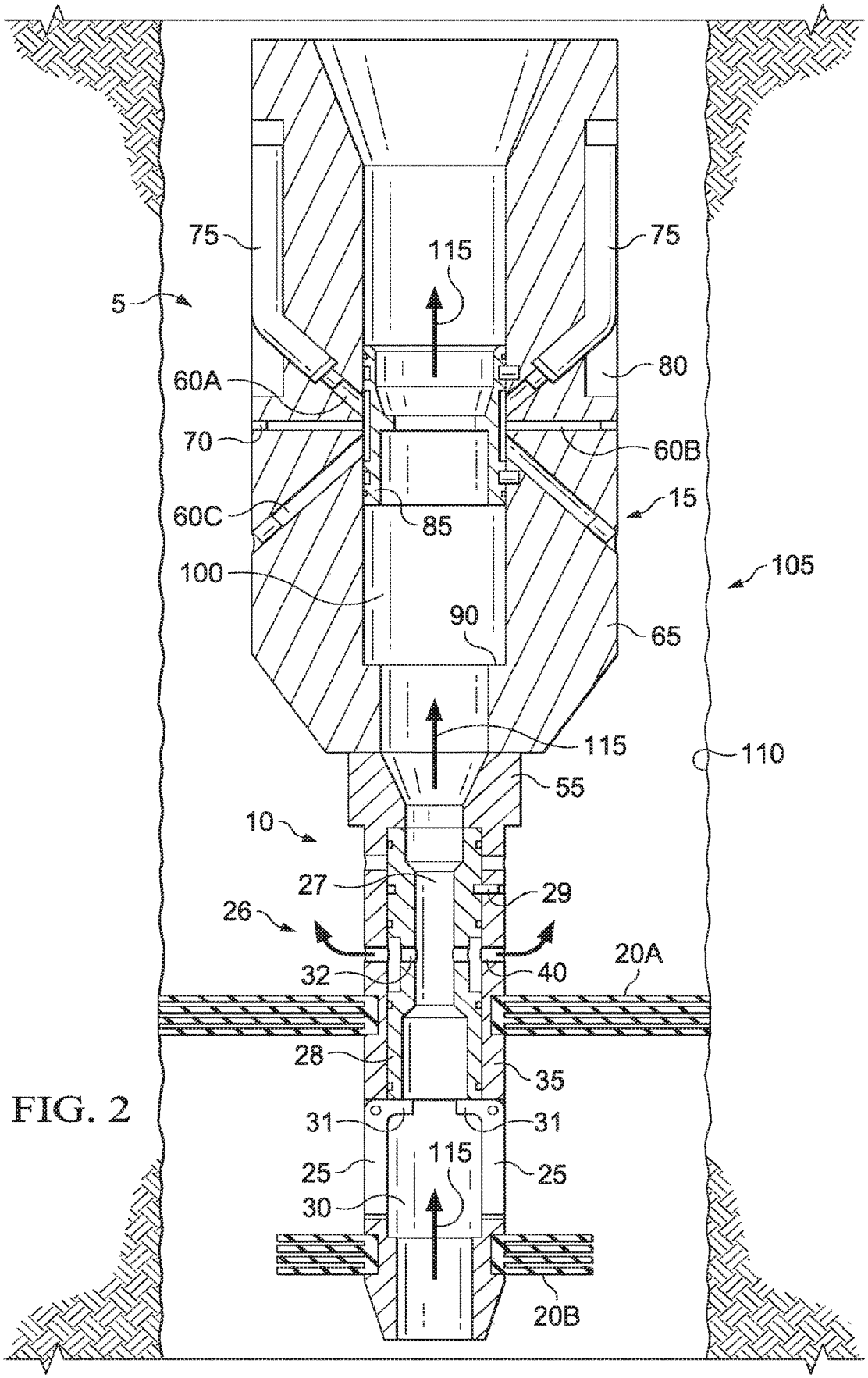
FIG. 2 is a cross-section schematic illustrating the cement plugging apparatus in its run-in-hole configuration in accordance with the examples disclosed herein.

FIG. 2 is a cross-section schematic illustrating the cement plugging apparatus 5 in its run-in-hole configuration. As illustrated, the plug fundament assembly 10 and the cement diverting assembly 15 are coupled at the disconnect assembly 55. The dogs 25 are in the axial orientation. Hoses 75 may be tucked into the grooves 80 within the body 65 of the cement diverting assembly 15.

As the cement plugging apparatus 5 is run downhole through a wellbore 105, the wiper elements 20A and 20B are sufficiently flexible to pass by any variances or deviations in the inner diameter of wellbore 105 including variances in the walls 110 of the wellbore 105. Should the cement plugging assembly 5 descend downhole through a casing instead, the wiper elements 20A and 20B are still sufficiently flexible to pass by any variances or deviations in the inner diameter of said casing. As the cement plugging assembly 5 descends downhole, fluid (e.g., drilling fluid) remaining in the wellbore 105 may be passed through the throughbore 30 of the plug fundament assembly 10 and the throughbore 100 of the cement diverting assembly 15 in the direction of arrows 115. The shear sleeve 85 of the cement diverting assembly 15 may cover and seal the openings of flow channels 60A, 60B, and 60C to reduce or prevent fluid flow through the flow channels as the cement plugging apparatus 5 is run-in-hole.

Figure 3:
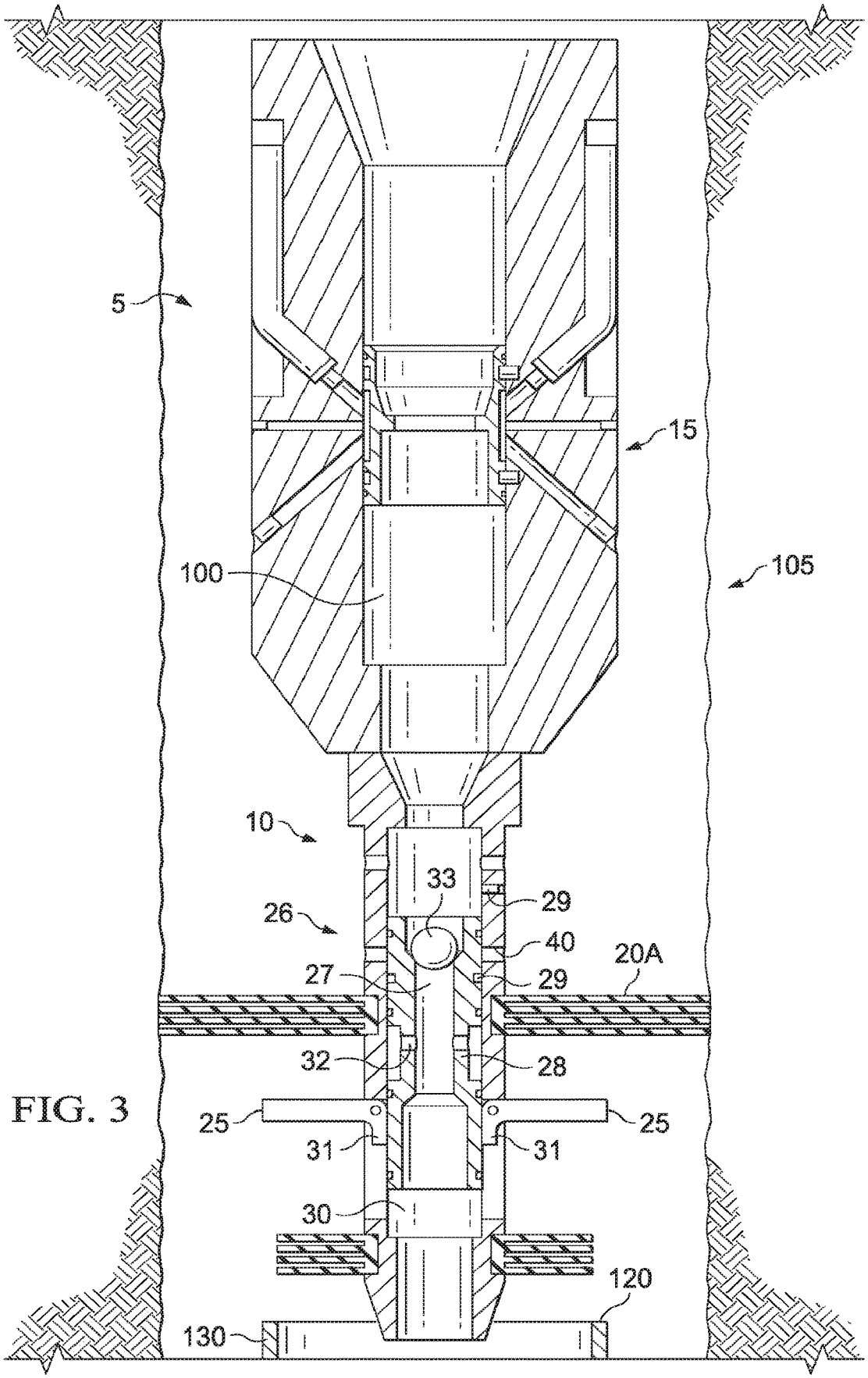
FIG. 3 is a cross-section schematic illustrating the cement plugging apparatus as the dogs are actuated in accordance with the examples disclosed herein.

FIG. 3 is a cross-section schematic illustrating the cement plugging apparatus 5 as the dogs 25 are actuated. As cement plugging apparatus 5 continues its descent downhole, the dogs 25 may be oscillated into their transverse orientation by dog actuation assembly 26. In the illustrated example, as the cement plugging apparatus 5 approaches the casing stub 120 of a section milled window of the casing string 130 in the wellbore 105 (i.e., the stub of the remaining casing string 130 at the bottom of the milled window of casing string 130), a projectile 33, may be released uphole. The projectile 33 may seat and apply pressure to shear the shear pins 29 which may induce dog actuation sleeve 28 to translate downhole and contact a lip 31 of each dog 25. This contact pushes the lip 31 in such manner as to induce the dogs 25 to shift to their transverse orientation. The projectile 33 may remain to block the throughbores 27 and 30 and be configured to be seated on a collar, shoulder, etc. that is uphole of the circulation ports 40. In this particular configuration, the projectile 33 may then be used to block fluid flow through the throughbores 27 and 30 and would also prevent cement or other sealant from flowing downwards through the assembly. The translation of the dog actuation sleeve 28 also shifts the side ports 29 downhole so that they no longer align with circulation ports 40 and fluid flow through circulation ports 40 is blocked.

Figure 4:
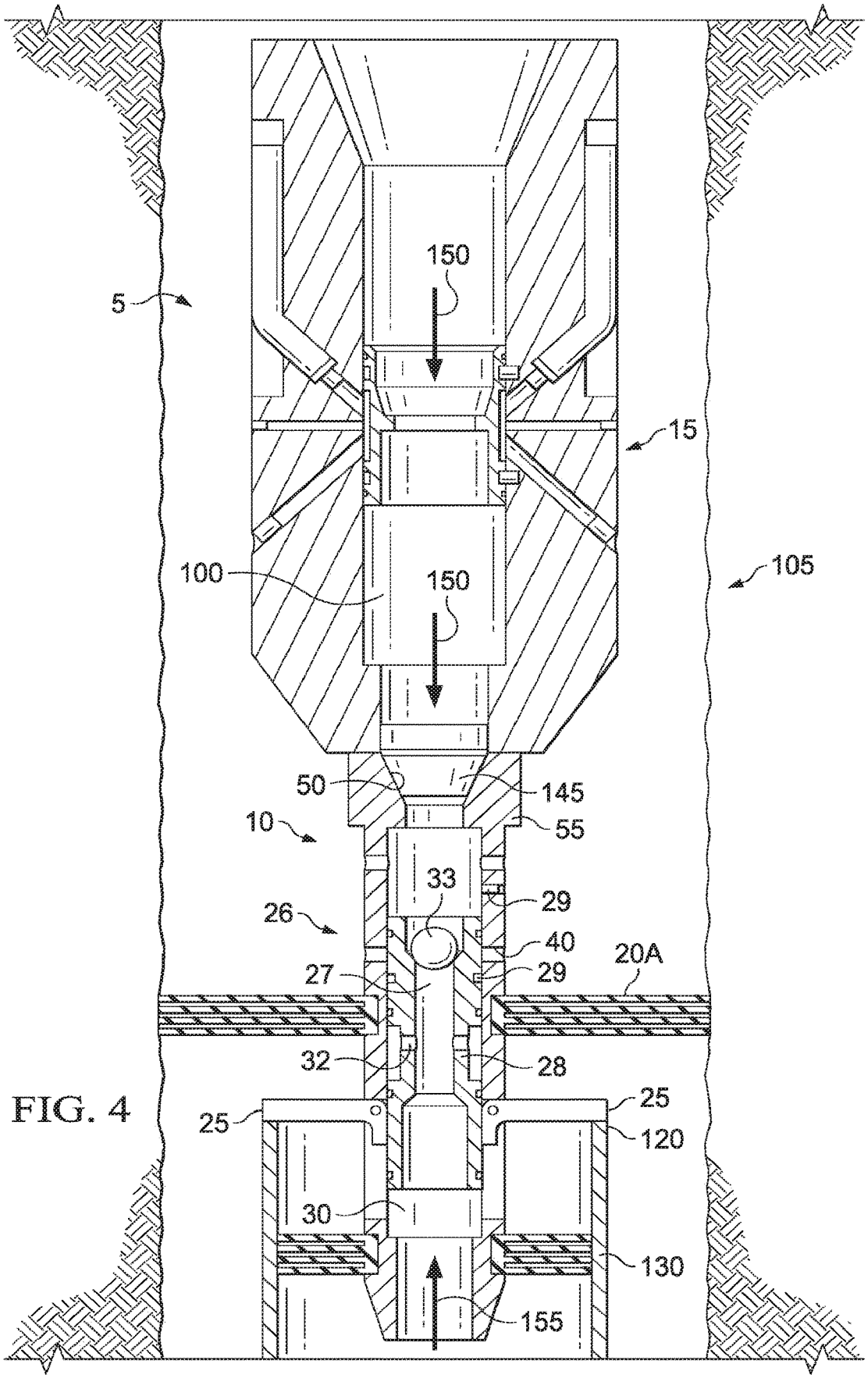
FIG. 4 is a cross-section schematic illustrating the cement plugging apparatus as the plug fundament assembly is disconnected from the cement diverting assembly in accordance with the examples disclosed herein.

FIG. 4 is a cross-section schematic illustrating the cement plugging apparatus 5 as the plug fundament assembly 10 is disconnected from the cement diverting assembly 15. As cement plugging apparatus 5 approaches casing stub 120, the dogs 25 may contact casing stub 120 and position the plug fundament assembly 10 on casing stub 120. A dart 145, or other projectile, may be released uphole and travel downhole and through throughbore 100 as illustrated by arrows 150. The dart 145 may land on the projectile seat 50 of the disconnect assembly 55 and actuate a releasing means of the disconnect assembly 55 to disconnect the plug fundament assembly 10 from the cement diverting assembly 15. The dart 145 may continue to sit in projectile seat 50 when disconnected.

Figure 5:
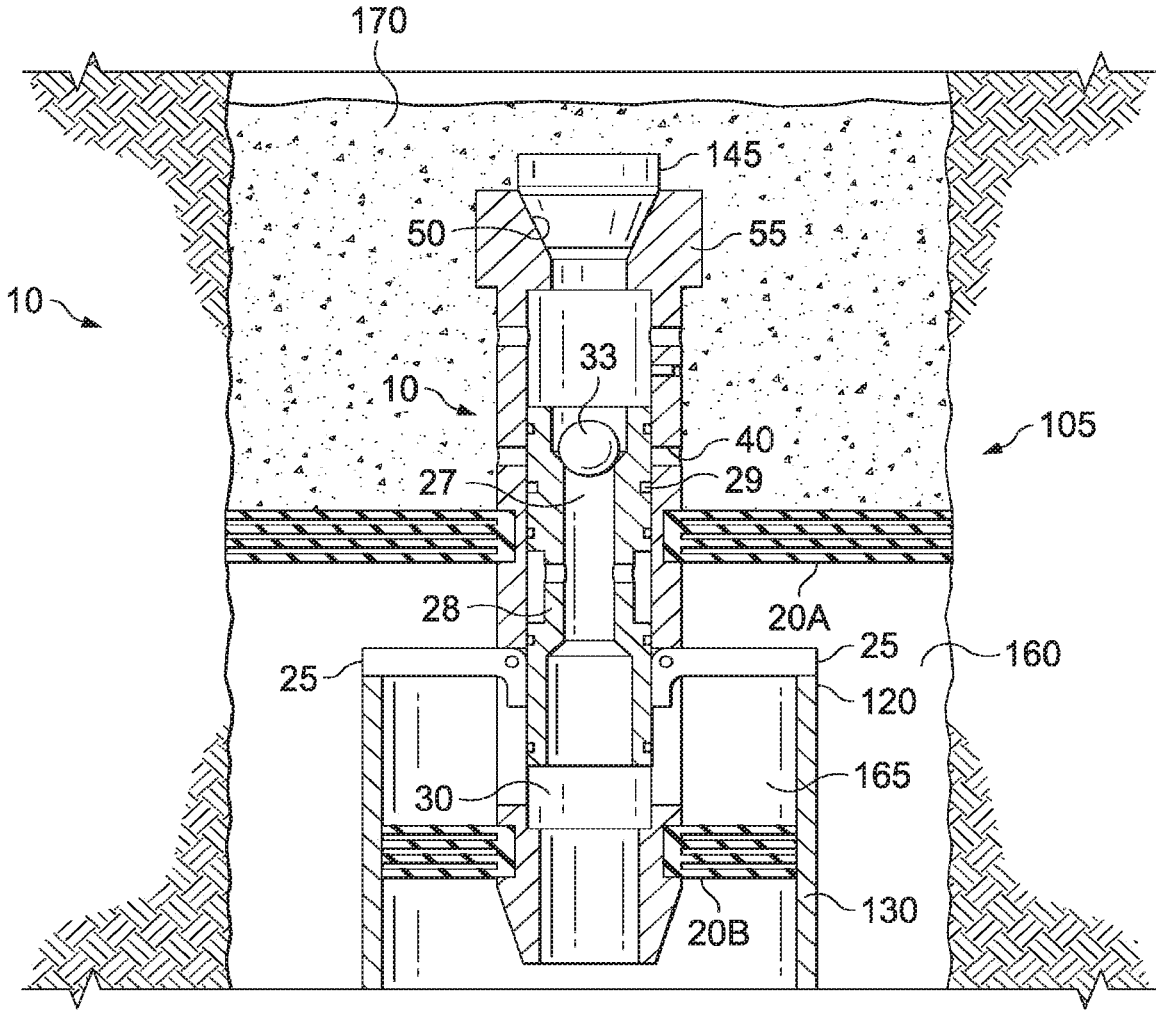
FIG. 5 is a cross-section schematic illustrating the disconnected plug fundament assembly as it may be used to form the plug fundament in accordance with the examples disclosed herein.

FIG. 5 is a cross-section schematic illustrating the disconnected plug fundament assembly 10 as it may be used to form the plug fundament. Once disconnected and deployed at the area of the section milled window, the wiper elements 20A may prevent cement from dropping into the wellbore annulus 160. The wiper elements 20B may prevent cement from flowing through the casing annulus 165. The dogs 25 may prevent the plug fundament assembly 10 from passing through the casing stub 120 and into the casing string 130.

The wiper elements 20A are sufficiently rigid to support the additional weight of the cement ejected uphole from the cement diverting assembly 15. The ejected cement may collect and set into the cement plug 170 on top of the plug fundament assembly 10. The plug fundament assembly 10 thus forms a permanent fundament for the cement plug 170. Moreover, there is no need for the installation of temporary bridge plugs, packers, or the use of high viscosity pills to form the plug fundament. As such, a shortened section milled window may be used to successfully install the cement plug 170. Since the section milled window may be shortened, less milling of the casing and casing collars may be required. For example, the cement plug 170 may be installed across the casing stub 120 in a section milled window of 40 meters or less in length. The plug fundament assembly 10 may alternatively be used in any size milled window, including those greater than 40 meters. For example, the plug fundament assembly 10 may be used to install a cement plug 170 in a milled window section of 200 meters or greater in length. Further, the plug fundament assembly 10 may be installed as illustrated without regards for current wellbore conditions. For example, if there is water, barite, cement, or drilling fluid already in the annulus, the plug fundament assembly 10 may be installed regardless.

Although use of the plug fundament assembly 10 in a section milled window is described, it is to be understood that the plug fundament assembly 10 may be used in any wellbore or wellbore section where a plug may be installed. Examples include, but are not limited to, open hole, cased hole, under casing shoe, under end of casing/tubing, etc.

In alternative examples, plug fundament assembly 10 may be used independently of cement diverting assembly 15. For example, the plug fundament assembly 10 may be run in hole without being coupled to the cement diverting assembly 15 and may be used to form a cement plug fundament in a wellbore. The cement diverting assembly 15 may then be lowered downhole to place the cement for the cement plug 170. Alternatively, cement may be placed on the fundament provided by plug fundament assembly 10 without the use of the cement diverting assembly 15.

Figure 6:
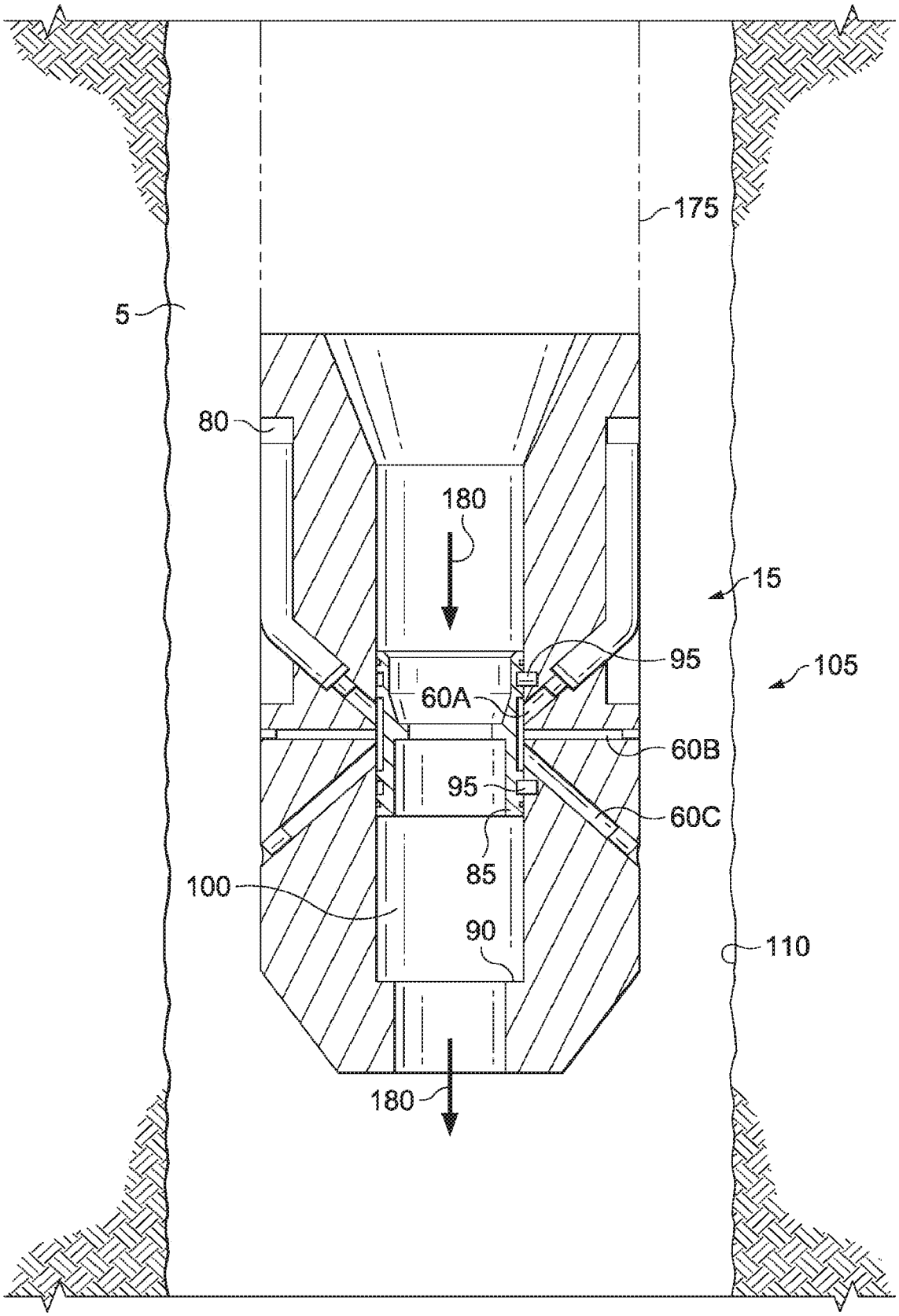
FIG. 6 is a cross-section schematic illustrating the disconnected cement diverting assembly prior to distributing cement in the wellbore in accordance with the examples disclosed herein.

FIG. 6 is a cross-section schematic illustrating the disconnected cement diverting assembly 15 prior to distributing cement in the wellbore 105. Once disconnected and deployed at the area of the section milled window, the cement diverting assembly 15 may be used to distribute cement downhole on top of the disconnected plug fundament assembly 10 as illustrated in FIG. 5. As discussed above, the shear sleeve 85 is held in place by shear pins 95. The shear sleeve 85 covers and seals the flow paths 60A, 60B, and 60C. As such, any cement flowed downhole from drillpipe 175 through throughbore 100 would pass downhole straight through the center of cement diverting assembly 15 in the direction of arrows 180. Flowing cement out through throughbore 100 may result in a poor distribution of cement for a cement plug (e.g., cement plug 170 as illustrated in FIG. 5). Such a distribution of cement may not reach the walls 110 of the wellbore 105, or efficiently displace a prior pumped fluid, such as a drilling fluid, from the wellbore. As such, multiple trips may have to be made to repeatedly place more cement if the cement plug is not found to be sufficiently competent when tested.

Figure 7:
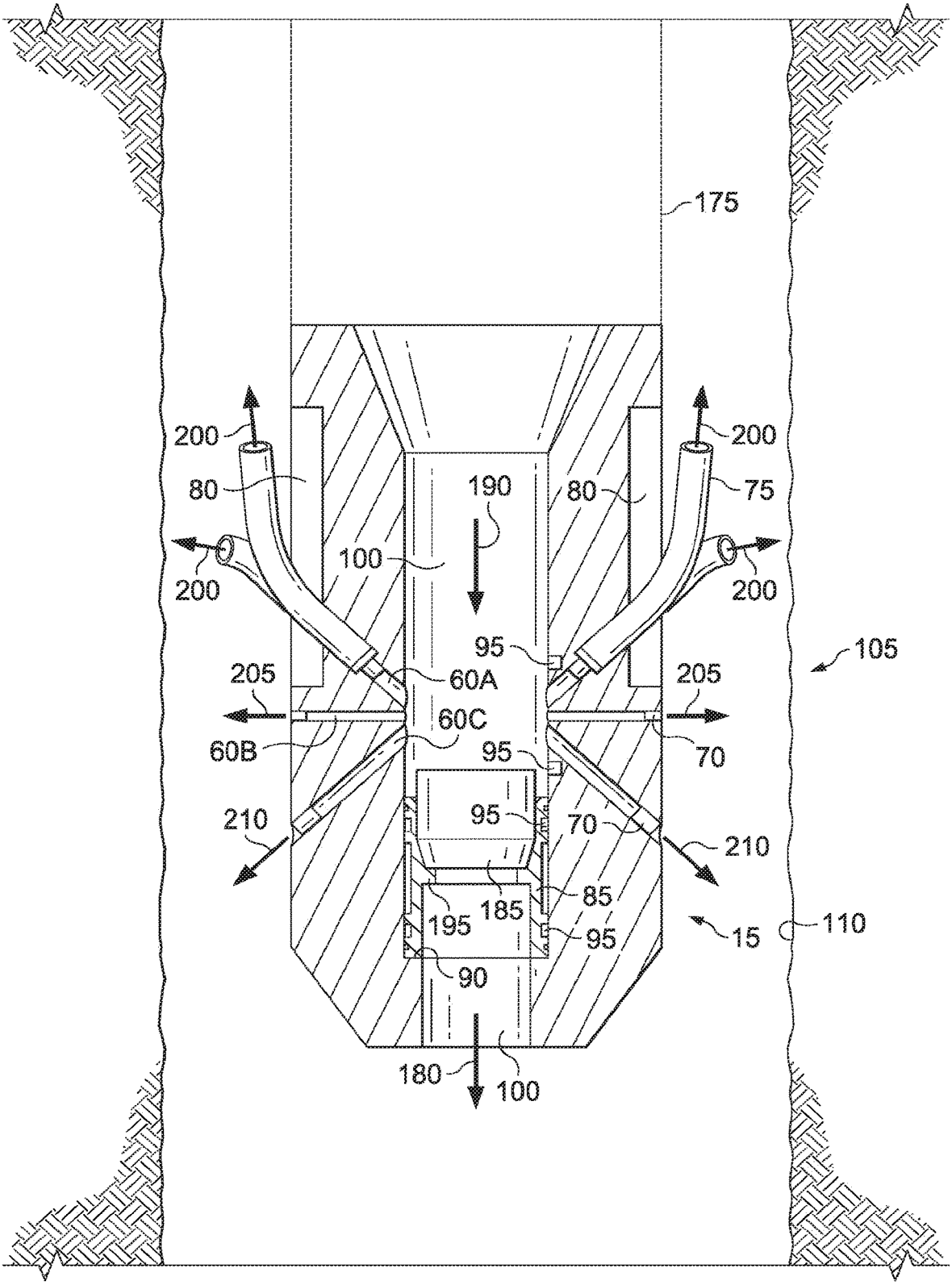
FIG. 7 is a cross-section schematic illustrating the disconnected cement diverting assembly as it diverts cement through multiple angled flow paths in accordance with the examples disclosed herein.

FIG. 7 is a cross-section schematic illustrating the disconnected cement diverting assembly 15 as it diverts cement through the flow paths 60A, 60B, and 60C. When deployed to distribute cement, a dart 185 may be released uphole, where it may descend downhole in the direction of arrow 190 into the throughbore 100 where it may contact and apply pressure to a sleeve collar 195 of the shear sleeve 85. The applied pressure may induce shearing of the shear pins 95, which may translate the shear sleeve 85 downhole to where it may contact the sleeve seat 90 and block flow through the throughbore 100. This translation of shear sleeve 85 may uncover the openings of the flow paths 60A, 60B, and 60C, and allow fluid to enter the flows paths 60A, 60B, and 60C.

The cement diverting assembly 15 may be used to distribute cement downhole on top of the disconnected plug fundament assembly 10 as illustrated in FIG. 5 to form a cement plug (e.g., cement plug 170 as illustrated in FIG. 5) on the plug fundament assembly 10 as illustrated in FIG. 5. Referring again to FIG. 7, open flow paths 60A, 60B, and 60C may eject the diverted cement flow from the throughbore 100 into the wellbore 105. Upper flow paths 60A may flow cement through hoses 75, which may come free from grooves 80 as cement flows therethrough. The unsupported hoses 75 may extend outwardly away from the cement diverting assembly 15 towards the walls 110 of the wellbore 105 in the area of the section milled window and may whip the cement as it flows through the hoses 75. The flexible hoses 75 may whip the cement outwardly in the direction of arrows 200, where the cement may contact the walls 110 of the wellbore 105 and descend downhole to plug fundament assembly 10 to displace a prior pumped fluid and set into a cement plug as discussed above. The flexible hoses 75 may extend to the walls 110 of the wellbore and conduct the cement flow directly into contact with the wellbore walls 110. Nozzles (e.g., flow-diverting nozzles) may be installed at the hose ends to enhance the efficiency of the flow distribution and/or straighten the hose 75 ends. Middle flow paths 60B eject cement outwardly in the direction of arrows 205. The spray and range of the cement flow may be altered by adjustment of the nozzles 70 inserted into the terminal ends of middle flow paths 60B to achieve a desired spray and range for the ejected cement flow. The ejected cement flow may descend into a different area of the wellbore 105 than the cement flow ejected from upper flow paths 60A, depending on the angle of the incline of middle flow paths 60B and the nozzles 70 inserted into the terminal ends of middle flow paths 60B. The ejected cement flow from middle flow paths 60B descends downhole to plug fundament assembly 10 to displace a prior pumped fluid and set into a cement plug as discussed above. Lower flow paths 60C eject cement outwardly in the direction of arrows 210. The spray and range of the cement flow may be altered by adjustment of the nozzles 70 inserted into the terminal ends of lower flow paths 60C to achieve a desired spray and range for the ejected cement flow. The ejected cement flow may descend into a different area of the wellbore than the cement flow ejected from the upper flow paths 60A and the middle flow paths 60B, depending on the angle of the incline of lower flow paths 60C and the nozzles 70 inserted into the terminal ends of lower flow paths 60C. The ejected cement flow from lower flow paths 60C descends downhole to plug fundament assembly 10 to displace a prior pumped fluid and set into a cement plug as discussed above.

The different ejection angles and distributions of the ejected cement flow from the flow paths 60A, 60B, and 60C may result in a more even distribution of cement for the cement plug (e.g., cement plug 170 as illustrated in FIG. 5), such that the cement does not merely flow down the center of the wellbore 105 and pool there. This even distribution of cement may also more efficiently displace a prior pumped fluid. As such, multiple trips may not have to be made to place additional cement to form a cement plug. As illustrated in FIGS. 1-7, the cement plugging apparatus 5 may be used to place a cement plug fundament and to evenly distribute cement on the cement plug fundament to form a competent cement plug in a single trip. The cement plug may be formed across a casing stub (e.g., casing stub 120 as illustrated in FIG. 5), in a shortened section milled window regardless of the wellbore conditions downhole. The string may be rotated and/or reciprocated during this operation.

Although cement diverting assembly 15 is illustrated as placing cement to for a cement plug (e.g., cement plug 170 as illustrated in FIG. 5). It is to be understood that the cement diverting assembly 15 may be used to place any type of fluid, including other sealants to form non-cement plugs. Moreover, in some examples, the cement diverting assembly 15 may be used to displace one fluid with another instead of placing a fluid that sets or hardens. For example, the cement diverting assembly 15 may be used to displace a drilling fluid with a spacer fluid, etc. Additionally, the cement diverting assembly 15 may be used to place a gelling fluid with a gel consistency that does not set, but maintains a highly viscous gel state.

With reference to FIG. 7, the cement diverting assembly 15 may be retrieved by withdrawing the attached drillpipe 175 from the wellbore 105. The cement diverting assembly 15 may then be cleaned and reset, for example, by removing the dart 185, resetting the shear sleeve 85, etc. The cement diverting assembly 15 may then be reused as a cement or fluid diverter, or coupled to a new plug fundament assembly 10 and reused as the cement plugging apparatus 5 to place a new cement plug.

In alternative examples, cement diverting assembly 15 may be used independently of plug fundament assembly 10. For example, the cement diverting assembly 15 may be run in hole without being coupled to the plug fundament assembly 10 and may be used to place a cement in a wellbore 105. The cement diverting assembly 15 may then be retrieved and reused if desired.

In some examples, the cement diverting assembly 15 may be omitted or not activated, and only the plug fundament assembly 10 may be used to form a plug fundament for a specific application.

Figure 8:
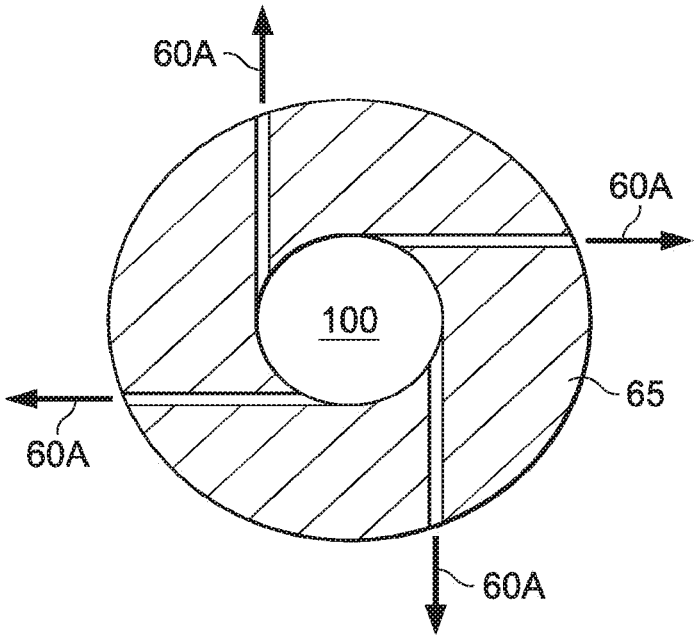
FIG. 8 is a cross-section schematic illustrating an alternative example of flow path arrangement through the body of the cement diverting assembly in accordance with the examples disclosed herein.

FIG. 8 is a cross-section of an alternative example of flow path arrangement through body 65. Flow paths, for example, flow paths 60A may extend radially through body 65 as discussed above in FIGS. 1-7. Alternatively, the flow paths may extend through body 65 at an angle that is not radial, in addition to any inclination. FIG. 8 illustrates one such example orientation for flow paths 60A. Flow paths 60B and 60C may also be oriented at this same angle or a different angle. It is to be understood that the flow paths 60A, 60B, 60C, etc. may extend through body 65 of the cement diverting assembly 15 at any angle as desired and also at any inclination as desired.

Examples of the methods and systems described herein comprise the use of a cement (i.e., a cement slurry). Any of a variety of hydraulic cements suitable for use in subterranean cementing operations may be used as the cement. Suitable examples include hydraulic cements that comprise calcium, aluminum, silicon, oxygen, and/or sulfur, and which set and harden by reaction with water. Such hydraulic cements, include, but are not limited to, Portland cements, pozzolana cements, gypsum cements, high-alumina-content cements, slag cements, silica/lime cements, or any combination thereof. In certain specific examples, the hydraulic cement may comprise a Portland cement. The Portland cements that may be suitable for use include Portland cements classified as Class A, C, H and G cements according to American Petroleum Institute, Recommended Practice for Testing Well Cements, API Specification 10B-2 (ISO 10426-2), First edition, July 2005. In addition, in some examples, cements suitable for use may include cements classified as ASTM Type I, II, III, IV, or V.

Example systems may also comprise a pump fluidly coupled to a conduit (e.g., drillpipe 175 coupled to the cement plugging apparatus 5) containing a cement. The pump may be a high-pressure pump or a low-pressure pump. As used herein, the term "high pressure pump" will refer to a pump that is capable of delivering a fluid downhole at a pressure of about 1000 psi or greater. Suitable high-pressure pumps will be known to one having ordinary skill in the art and may include, but are not limited to, floating piston pumps and positive displacement pumps. In other examples, the pump may be a low-pressure pump. As used herein, the term "low pressure pump" will refer to a pump that operates at a pressure of about 1000 psi or less. Suitable low-pressure pumps will be known to one having ordinary skill in the art.

In some examples, the systems described herein may further comprise a mixing tank that is upstream of the pump and is the vessel in which the cement is formulated. In various examples, the pump (e.g., a low-pressure pump, a high-pressure pump, or a combination thereof) may convey the cement from the mixing tank to the transporting conduit. In other examples, the cement may be formulated offsite and transported to a worksite, in which case the cement may be introduced to the transporting conduit via the pump, either directly from its shipping container (e.g., a truck, a railcar, a barge, boat or the like) or from a transport pipeline. In either case, the cement may be drawn into the pump, elevated to an appropriate pressure, and then introduced into the transporting conduit for delivery downhole.

It should be clearly understood that the examples illustrated by FIGS. 1-8 are merely general applications of the principles of this disclosure in practice, and a wide variety of other examples are possible. Therefore, the scope of this disclosure is not limited in any manner to the details of FIGS. 1-8 described herein.

It is also to be recognized that the disclosed cement plugging apparatus may also directly or indirectly affect the various downhole equipment and tools that may come into direct or indirect contact with the cement plugging apparatus during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-7.

Provided are cement plugging apparatuses in accordance with the disclosure and the illustrated FIGs. An example apparatus comprises a detachable plug fundament assembly comprising a throughbore and a first plurality of wiper elements and a second plurality of wiper elements, and a cement diverting assembly coupled to the plug fundament assembly, wherein the cement diverting assembly comprises a plurality of hoses, a body, a throughbore, and a first plurality of flow paths, wherein each individual hose is coupled to an individual flow path in the first plurality of flow paths, and wherein each individual hose extends away from the body of the cement diverting assembly.

Additionally or alternatively, the cement plugging apparatus may include one or more of the following features individually or in combination. The hoses may be unsupported on their terminal ends and may be configured to whip a diverted cement flow away from the cement diverting assembly. The hoses may be unsupported on their terminal ends and may be configured to conduct the cement flow away from the cement diverting assembly and directly into contact with the wall of the wellbore. The hoses may be configured with nozzles at the ends. The hoses may be configured with flow-diverting nozzles at the ends. The cement plugging apparatus may further comprise a second plurality of flow paths, wherein each individual flow path within the second plurality of flow paths is configured to extend through the body of the cement diverting assembly at a different angle than the individual flow paths in the first plurality of flow paths. The first plurality of wiper elements may comprise individual wiper elements of different lengths, diameter, material, or shape from the individual wiper elements in the second plurality of wiper elements. The plug fundament assembly may comprises dogs and the dogs may be oriented in axial or transverse positions. The plug fundament assembly may comprise a dog actuation assembly comprising: at least two dogs, a ball configured to prevent flow downhole of the ball through the throughbore in the plug fundament assembly, and a dog actuation sleeve disposed in the throughbore of the plug fundament assembly; wherein the ball may actuate the dog actuation sleeve; and wherein the dog actuation sleeve may actuate the dogs. The cement diverting assembly may further comprise a shear sleeve in the throughbore of the cement diverting assembly and wherein the shear sleeve covers openings in the throughbore of the flow paths in the first plurality of flow paths. The shear sleeve may be coupled to shear pins and wherein the shear sleeve may be configured to translate downhole if the shear pins are sheared, wherein the downhole translation of the shear sleeve uncovers the openings in the throughbore of the flow paths in the first plurality of flow paths. The shear pins may be sheared under pressure applied to the shear sleeve by a projectile, wherein the projectile may land on a sleeve seat within the shear sleeve and induce shearing of the shear pins, and wherein the projectile on the sleeve seat and the shear sleeve may block fluid flow downhole of the shear sleeve through the throughbore of the cement diverting assembly. The cement plugging apparatus may further comprise a disconnect assembly which may decouple the plug fundament assembly from the cement diverting assembly and place the plug fundament assembly in a casing stub in a wellbore.

Provided are plug fundament assemblies in accordance with the disclosure and the illustrated FIGs. An example assembly comprises a throughbore, a first plurality of wiper elements, and a second plurality of wiper elements.

Additionally or alternatively, the plug fundament assembly may include one or more of the following features individually or in combination. The plug fundament assembly may further comprise dogs. The plug fundament assembly may further comprise a ball configured to prevent flow downhole of the ball through the throughbore in the plug fundament assembly, and a dog actuation sleeve disposed in the throughbore of the plug fundament assembly; wherein the ball actuates the dog actuation sleeve; and wherein the dog actuation sleeve actuates the dogs. The first plurality of wiper elements may comprise individual wiper elements of different lengths, diameter, shape, or material from the individual wiper elements in the second plurality of wiper elements. The plug fundament assembly may further comprise circulation ports located in a body of the plug fundament assembly.

Provided are cement diverting assemblies in accordance with the disclosure and the illustrated FIGs. An example cement diverting assembly comprises a plurality of hoses, a body, a throughbore, and a first plurality of flow paths, wherein each individual hose is coupled to an individual flow path in the first plurality of flow paths, and wherein each individual hose extends away from the body of the cement diverting assembly.

Additionally or alternatively, the cement diverting assembly may include one or more of the following features individually or in combination. The hoses may be unsupported on their terminal ends and may be configured to whip a diverted cement flow away from the cement diverting assembly. The hoses may be unsupported on their terminal ends and may be configured to conduct the cement flow away from the cement diverting assembly and directly into contact with the wall of the wellbore. The hoses may be configured with nozzles at the ends. The hoses may be configured with flow-diverting nozzles at the ends. The cement diverting assembly may further comprise a second plurality of flow paths, wherein each individual flow path within the second plurality of flow paths is configured to extend through the body of the cement diverting assembly at a different angle than the individual flow paths in the first plurality of flow paths. The cement diverting assembly may further comprise a shear sleeve in the throughbore of the cement diverting assembly; and wherein the shear sleeve covers openings in the throughbore of the flow paths in the first plurality of flow paths. The shear sleeve may be coupled to shear pins; wherein the shear sleeve is configured to translate downhole if the shear pins are sheared, and wherein the downhole translation of the shear sleeve uncovers the openings in the throughbore of the flow paths in the first plurality of flow paths. The shear pins may be sheared under pressure applied to the shear sleeve by a projectile, wherein the projectile may land on a sleeve seat within the shear sleeve and induce shearing of the shear pins, and wherein the projectile on the sleeve seat and the shear sleeve may block fluid flow downhole of the shear sleeve through the throughbore of the cement diverting assembly. The cement diverting assembly may further comprise grooves in the body of the cement diverting assembly; and wherein the hoses may be placed in the grooves until a fluid is flowed through the hoses.

Provided are methods of using a cement plugging apparatus in accordance with the disclosure and the illustrated FIGs. An example method comprises introducing a cement plugging apparatus into a wellbore, the cement plugging apparatus comprising: a detachable plug fundament assembly comprising: a throughbore, a first plurality of wiper elements, and a second plurality of wiper elements, and a cement diverting assembly coupled to the plug fundament assembly, wherein the cement diverting assembly comprises: a plurality of hoses, a body, a throughbore in the body, and a plurality of flow paths extending through the body and having openings for each individual flow path in the throughbore; wherein each individual hose in the plurality is coupled to an individual flow path in the plurality of flow paths; wherein each individual hose in the plurality extends away from the body of the cement diverting assembly. The method further comprises detaching the plug fundament assembly by decoupling the plug fundament assembly from the cement diverting assembly; placing the detached plug fundament assembly in a casing stub within the wellbore to form a cement plug fundament; and flowing cement through the cement diverting assembly to place the cement on top of the cement plug fundament to set into the cement plug.

Additionally or alternatively, the method may include one or more of the following features individually or in combination. The plug fundament assembly may further comprise dogs, wherein the dogs place the plug fundament assembly in the casing stub. The cement plug may form on top of the first plurality of wiper elements. The plurality of hoses may conduct the flowing cement to contact a wall of the wellbore with the cement. The cement diverting assembly may further comprise a second plurality of flow paths, wherein each individual flow path within the second plurality of flow paths is configured to extend through the body of the cement diverting assembly at a different angle than the individual flow paths in the first plurality of flow paths. The cement diverting assembly may be retrievable. The method may further comprise retrieving and reusing the cement diverting assembly. The casing stub may be disposed in a section milled window less than 40 meters in length.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A cement plugging apparatus comprising:

a detachable plug fundament assembly comprising:

a throughbore, a first plurality of wiper elements, and a second plurality of wiper elements, and a cement diverting assembly coupled to the plug fundament assembly, wherein the cement diverting assembly comprises:

a plurality of hoses, a body, a throughbore in the body, and a plurality of flow paths extending through the body and having openings for each individual flow path in the throughbore; wherein each individual hose in the plurality is coupled to an individual flow path in the plurality; and wherein each individual hose in the plurality extends away from the body of the cement diverting assembly.

2. The cement plugging apparatus of claim 1, wherein the individual hoses in the plurality comprise terminal ends; wherein the individual hoses in the plurality are unsupported on their terminal ends; and wherein the individual hoses in the plurality are configured to whip a diverted cement flow away from the cement diverting assembly.

3. The cement plugging apparatus of claim 1, wherein the individual hoses in the plurality comprise terminal ends; wherein the individual hoses in the plurality are unsupported on their terminal ends; and wherein the individual hoses in the plurality are configured to conduct a diverted cement flow away from the cement diverting assembly and directly into contact with a wall of the wellbore.

4. The cement plugging apparatus of claim 1, wherein the individual hoses in the plurality comprise nozzles.

5. The cement plugging apparatus of claim 1, wherein the individual hoses in the plurality comprise flow-diverting nozzles.

6. The cement plugging apparatus of claim 1, further comprising a second plurality of flow paths, wherein each individual flow path within the second plurality of flow paths is configured to extend through the body at a different angle than the individual flow paths in the first plurality of flow paths.

7. The cement plugging apparatus of claim 1, wherein the first plurality of wiper elements comprises individual wiper elements of different lengths, diameter, material, or shape from the individual wiper elements in the second plurality of wiper elements.

8. The cement plugging apparatus of claim 1, wherein the plug fundament assembly comprises dogs, wherein the dogs may be oriented in axial or transverse positions.

9. The cement plugging apparatus of claim 1, wherein the plug fundament assembly comprises a dog actuation assembly comprising:

at least two dogs, a ball configured to prevent flow downhole of the ball through the throughbore in the plug fundament assembly, and a dog actuation sleeve disposed in the throughbore of the plug fundament assembly; and wherein the ball may actuate the dog actuation sleeve; and wherein the dog actuation sleeve may actuate the dogs.

10. The cement plugging apparatus of claim 1, wherein the cement diverting assembly further comprises a shear sleeve in the throughbore of the cement diverting assembly; and wherein the shear sleeve covers the openings in the throughbore of the flow paths in the plurality of flow paths.

11. The cement plugging apparatus of claim 10, wherein the shear sleeve is coupled to shear pins and wherein the shear sleeve is configured to translate downhole if the shear pins are sheared; and wherein the downhole translation of the shear sleeve uncovers the openings in the throughbore of the flow paths in the plurality of flow paths.

12. The cement plugging apparatus of claim 11, wherein the shear pins are sheared under pressure applied to the shear sleeve by a projectile; wherein the projectile lands on a sleeve seat within the shear sleeve and induces shearing of the shear pins by applying said pressure; and wherein the projectile on the sleeve seat and the shear sleeve block fluid flow downhole of the shear sleeve through the throughbore of the cement diverting assembly.

13. The cement plugging apparatus of claim 1, further comprising a disconnect assembly configured to decouple the plug fundament assembly from the cement diverting assembly.

14. A cement diverting assembly comprising:
a plurality of hoses,
a body,
a throughbore in the body, and
a plurality of flow paths extending through the body and having openings for each individual flow path in the throughbore; wherein each individual hose in the plurality is coupled to an individual flow path in the plurality of flow paths; wherein each individual hose in the plurality extends away from the body of the cement diverting assembly.

15. The cement diverting assembly of claim 14, wherein the individual hoses in the plurality comprise terminal ends; wherein the individual hoses in the plurality are unsupported on their terminal ends; and wherein the individual hoses in the plurality are configured to whip a diverted cement flow away from the cement diverting assembly.

16. The cement diverting assembly of claim 14, wherein the individual hoses in the plurality comprise terminal ends; wherein the individual hoses in the plurality are unsupported on their terminal ends; and wherein the individual hoses in the plurality are configured to conduct a diverted cement flow away from the cement diverting assembly and directly into contact with a wall of the wellbore.

17. The cement diverting assembly of claim 14, wherein the individual hoses in the plurality further comprise nozzles.

18. The cement diverting assembly of claim 14, wherein the individual hoses in the plurality further comprise flow-diverting nozzles.

19. The cement diverting assembly of claim 14, further comprising a second plurality of flow paths, wherein each individual flow path within the second plurality of flow paths is configured to extend through the body of the cement diverting assembly at a different angle than the individual flow paths in the first plurality of flow paths.

20. The cement diverting assembly of claim 14, further comprising a shear sleeve in the throughbore of the cement diverting assembly; and wherein the shear sleeve covers the openings in the throughbore of the flow paths in the plurality of flow paths.

21. The cement diverting assembly of claim 20, wherein the shear sleeve is coupled to shear pins and wherein the shear sleeve is configured to translate downhole if the shear pins are sheared, wherein the downhole translation of the shear sleeve uncovers the openings in the throughbore of the flow paths in the plurality of flow paths.

22. The cement diverting assembly of claim 21, wherein the shear pins may be sheared under sufficient pressure applied to the shear sleeve by a projectile, wherein the projectile may land on a sleeve seat within the shear sleeve and induce shearing of the shear pins, wherein the projectile on the sleeve seat and the shear sleeve may block fluid flow downhole of the shear sleeve through the throughbore of the cement diverting assembly.

23. The cement diverting assembly of claim 14, further comprising grooves in the body of the cement diverting assembly; wherein the hoses are configured to be disposed in the grooves prior to a fluid being flowed through the hoses.

24. A method for forming a cement plug, the method comprising:
introducing a cement plugging apparatus into a wellbore, the cement plugging apparatus comprising:
a detachable plug fundament assembly comprising:
a throughbore,
a first plurality of wiper elements, and
a second plurality of wiper elements, and
a cement diverting assembly coupled to the plug fundament assembly, wherein the cement diverting assembly comprises:
a plurality of hoses,
a body,
a throughbore in the body, and
a plurality of flow paths extending through the body and having openings for each individual flow path in the throughbore; wherein each individual hose in the plurality is coupled to an individual flow path in the plurality of flow paths; wherein each individual hose in the plurality extends away from the body of the cement diverting assembly;
detaching the plug fundament assembly by decoupling the plug fundament assembly from the cement diverting assembly;
placing the detached plug fundament assembly in a casing stub within the wellbore to form a cement plug fundament; and
flowing cement through the cement diverting assembly to place the cement on top of the cement plug fundament to set into the cement plug.

25. The method of claim 24, wherein the plug fundament assembly further comprises dogs, wherein the dogs place the plug fundament assembly in the casing stub.

26. The method of claim 24, wherein the cement plug forms on top of the first plurality of wiper elements.

27. The method of claim 24, wherein the plurality of hoses conduct the flowing cement to contact a wall of the wellbore with the cement.

28. The method of claim 24, wherein the cement diverting assembly further comprises a second plurality of flow paths, wherein each individual flow path within the second plurality of flow paths is configured to extend through the body of the cement diverting assembly at a different angle than the individual flow paths in the first plurality of flow paths.

29. The method of claim 24, wherein the cement diverting assembly is retrievable.

30. The method of claim 24, further comprising retrieving and reusing the cement diverting assembly.

31. The method of claim 24, wherein the casing stub is disposed in a section milled window less than 40 meters in length.

* * * * *